US010622166B2

(12) United States Patent
Zhang et al.

(10) Patent No.: US 10,622,166 B2
(45) Date of Patent: Apr. 14, 2020

(54) DISCONNECTING SWITCH HAVING ANTI-ICING DEVICE

(71) Applicant: ABB Schweiz AG, Baden (CH)

(72) Inventors: Jian Zhang, Beijing (CN); Han Wang, Beijing (CN); Xuan Liu, Beijing (CN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/998,469

(22) Filed: Aug. 15, 2018

(65) Prior Publication Data

US 2019/0006128 A1 Jan. 3, 2019

Related U.S. Application Data

(63) Continuation of application No. PCT/CN2016/074643, filed on Feb. 26, 2016.

(51) Int. Cl.

| | |
|---|---|
| ***H01H 1/64*** | (2006.01) |
| ***H01H 3/46*** | (2006.01) |
| ***H01H 9/26*** | (2006.01) |

(52) U.S. Cl.

CPC ..... *H01H 1/64* (2013.01); *H01H 3/46* (2013.01); *H01H 9/26* (2013.01); (Continued)

(58) Field of Classification Search

CPC .. H01H 1/64; H01H 3/46; H01H 9/26; H01H 31/34; H01H 31/36; H01H 31/02; (Continued)

(56) References Cited

U.S. PATENT DOCUMENTS 3,502,826 A * 3/1970 Friebe ..... H01H 31/00 200/48 R
3,530,265 A * 9/1970 Albright ..... H01H 33/24 174/144

(Continued)

FOREIGN PATENT DOCUMENTS

CN 2819422 Y 9/2006
CN 2859790 Y 1/2007

(Continued)

OTHER PUBLICATIONS

International Search Report and Written Opinion, International Patent Application No. PCT/CN2016/074643, dated Nov. 30, 2016, 15 pages including Machine Translation in English Provided.

(Continued)

*Primary Examiner* — Edwin A. Leon
*Assistant Examiner* — William A Bolton
(74) *Attorney, Agent, or Firm* — Taft Stettinius & Hollister LLP; J. Bruce Schelkopf

(57) ABSTRACT

A disconnector with an anti-icing arrangement includes a main blade moving contact, a main blade arm, a main blade static contact, a main blade transmission arrangement and a main blade anti-icing arrangement. The main blade transmission arrangement is adapted for driving the main blade arm to move. The main blade anti-icing arrangement includes a main blade anti-icing shield and a main blade anti-icing shield transmission arrangement. The main blade anti-icing shield transmission arrangement is adapted for drive the main blade anti-icing shield such that the main blade anti-icing shield shields the main blade moving contact in an opened position to keep ice and snow and rainwater from covering a surface of the main blade moving contact, and moves away from the main blade moving (Continued)

contact in a closed position, to enable the main blade moving contact to be contacted with the main blade static contact.

18 Claims, 6 Drawing Sheets

(52) U.S. Cl.
CPC . *H01H 2223/044* (2013.01); *H01H 2239/018* (2013.01); *H01H 2239/044* (2013.01)

(58) Field of Classification Search
CPC ..... H01H 2223/044; H01H 2239/018; H01H 2239/044
USPC ..... 200/48 R, 48 V, 48 KB, 48 CB, 48 SB
See application file for complete search history.

(56) References Cited

U.S. PATENT DOCUMENTS

| | | | | |
|---|---|---|---|---|
| 4,296,284 | A * | 10/1981 | Lott | H01H 31/023 200/304 |
| 4,504,708 | A * | 3/1985 | Hartig | H01H 1/023 200/337 |
| 5,382,764 | A | 1/1995 | Demissy | |
| 7,223,928 | B2 | 5/2007 | Riopka et al. | |
| 2006/0174638 | A1 | 8/2006 | Riopka et al. | |
| 2016/0055997 | A1* | 2/2016 | Demissy | H01H 1/42 200/48 P |

FOREIGN PATENT DOCUMENTS

| | | | |
|---|---|---|---|
| CN | 201868307 | U | 6/2011 |
| CN | 202650941 | U | 1/2013 |
| CN | 203617205 | U | 5/2014 |
| CN | 203674058 | U | 6/2014 |
| CN | 104319157 | A | 1/2015 |
| CN | 204215909 | U | 3/2015 |
| RU | 2234159 | C1 | 8/2004 |

OTHER PUBLICATIONS

Chinese Office Action, Chinese Patent Application No. 201680080966.8, dated Mar. 4, 2019, 18 pages including English translation.
Chinese Search Report, Chinese Patent Application No. 201680080966.8, dated Mar. 4, 2019, 3 pages.
European Patent Office, Extended European Search Report in corresponding application No. 16891036.2, dated Sep. 18, 2019, 9 pp.

* cited by examiner

DISCONNECTING SWITCH HAVING ANTI-ICING DEVICE

FIELD

The present invention belongs to the field of electrical power devices and relates to a disconnector with an anti-icing arrangement, and more particularly, to a disconnector with an earthing switch and an anti-icing arrangement.

BACKGROUND

A disconnector is a switching device that could provide, at an opening position, an insulation distance between contacts conforming to specified requirements and a distinct disconnection sign and could withstand, at a closing position, currents under a normal circuit condition and currents under an abnormal condition (e.g., short circuit) within a specified time. The disconnector is an important switching device in an electrical power system and its primary function is to ensure safety during maintenance of high-voltage electrical devices and apparatuses and to isolate the voltage.

In high latitude areas, such as northern cold regions, the temperature is quite low in winter and the operating environment is harsh. The ice and snow that cover the outdoor disconnector for a long time will impact reliability of opening and closing actions of the switch, such that contacts of the disconnector are separated by ice and cannot be completely conducted, which disables operations and threatens operation of electrical power systems and safety of power grids.

To solve the ice coating issues, the existing disconnector, while closing, usually enables the contact to have ice-breaking functionality. For example, when the moving contact and the static contact of the disconnector are being closed, a clamping and sliding procedure occurs to break the ice layer. However, this method for breaking the icing with an increased clamping force of the contact can only break the icing of a certain thickness, and cause wear of contacts, increase in operating force and a higher rigidity requirement. Besides, it also increases output torque of mechanisms and has a defect of higher costs. In the northern cold regions, the outdoor disconnector might be covered with an ice layer of up to 20 mm or more, whereas the existing disconnector can hardly ensure normal operations even in an environment with icing of 10 mm. Thus, it might impact operation of electrical power devices in a cold and freezing environment and cannot ensure safe and stable operations of the entire electrical system. The high-voltage disconnector even cannot open or close when the icing is heavy.

In order to solve this problem, the prior art also provides a light energy ice-breaking auxiliary arrangement. That is, solar energy is gathered and incident to a light-to-heat converter to convert light energy to thermal energy and achieve a purpose of breaking ice by heating. However, this light energy ice-breaking auxiliary arrangement and the heat ice-breaking auxiliary arrangements based on other principles have complex structure and lower reliability, and thus cannot meet needs of actual operations.

To satisfy the usage requirements of disconnector in northern cold regions, an outdoor disconnector with anti-icing function is in urgent need in the prior art, which still can perform reliable mechanical operations when the ice layer reaches a thickness of 20 mm at most.

SUMMARY

The purpose of the present invention is to solve the problem existing in the prior art and provide a disconnector with an anti-icing arrangement, such that the opening and closing actions of the outdoor disconnector can be performed reliably, thereby ensuring normal operation of the disconnector in high and cold regions.

The solution of the present invention provides a disconnector with an anti-icing arrangement. The disconnector comprises a main blade moving contact, a main blade arm, a main blade static contact and a main blade transmission arrangement that drives the main blade arm to move. The disconnector further comprises a main blade anti-icing arrangement that includes a main blade anti-icing shield and a main blade anti-icing shield transmission arrangement, wherein the main blade anti-icing shield transmission arrangement drives the main blade anti-icing shield such that the main blade anti-icing shield shields the main blade moving contact in an opening operation to keep ice and snow and rainwater from covering a surface of the main blade moving contact and moves away from the main blade moving contact in a closing operation, to enable the main blade moving contact to be contacted with the static contact.

According to a preferred embodiment of the present invention, the main blade anti-icing transmission arrangement comprises a joint and a transmission shaft, one end of the transmission shaft being connected via the joint to the main blade arm for moving along with the main blade arm, and another end of the transmission shaft being connected to the main blade anti-icing shield.

According to a preferred embodiment of the present invention, the main blade anti-icing shield transmission arrangement comprises a main blade slide rail secured on the main blade arm for enabling the main blade anti-icing shield to move along the main blade slide rail.

According to a preferred embodiment of the present invention, the main blade anti-icing shield includes a first part and a second part. The first part has an opening greater than an opening of the second part, to prevent movement of the main blade anti-icing shield from being blocked by an ice layer covering the main blade moving contact or the main blade arm during transition from an opened position to a closed position.

According to a preferred embodiment of the present invention, the main blade anti-icing shield has a cross section of arc, inverted U-shape, inverted V-shape, an upper half of a trapezoid or any combination thereof, for reliably shielding the main blade moving contact and facilitating fall of ice and snow and rainwater therefrom.

According to a preferred embodiment of the present invention, the main blade anti-icing arrangement further comprises a static contact anti-icing shield for shielding the main blade static contact and keeping ice and snow and rainwater from covering a surface of the main blade static contact.

According to a preferred embodiment of the present invention, the main blade static contact comprises a fitting, an aluminum stranded wire, a clamp fitting and a static contact copper bar, the static contact anti-icing shield being used for shielding the static contact copper bar.

According to a preferred embodiment of the present invention, the static contact anti-icing shield has a cross section of arc, inverted U-shape, inverted V-shape, an upper half of a trapezoid or any combination thereof, for reliably shielding the main blade static contact and facilitating fall of ice and snow and rainwater therefrom.

According to a preferred embodiment of the present invention, the disconnector further comprises a mounted earthing switch including an earthing switch static contact, an insulator, an earthing blade, a moving contact and a base.

The earthing switch further comprises an earthing switch anti-icing arrangement having an earthing switch anti-icing shield and an earthing switch anti-icing shield transmission arrangement, wherein the earthing switch anti-icing shield transmission arrangement drives the earthing switch anti-icing shield so that the earthing switch anti-icing shield shields the earthing switch moving contact in the opened position to keep ice and snow and rainwater from covering a surface of the earthing switch moving contact, and moves away from the earthing moving contact in the closing operation to enable the earthing switch moving contact to be contacted with the earthing switch static contact.

According to a preferred embodiment of the present invention, the earthing switch anti-icing shield transmission arrangement comprises a crank and a connecting rod, one end of the earthing switch being connected to the base, the crank being connected between the base and the earthing switch, one end of the connecting rod being secured on the earthing switch and another end of the connecting rod being connected to the earthing switch anti-icing shield.

According to a preferred embodiment of the present invention, the earthing blade anti-icing shield transmission arrangement comprises an earthing blade slide rail secured on the earthing blade for enabling the earthing blade anti-icing shield to move along the earthing blade slide rail.

According to a preferred embodiment of the present invention, the earthing switch anti-icing shield comprises a front segment and a rear segment, and the front segment has an opening greater than that of the rear segment to prevent movement of the earthing switch anti-icing shield from being blocked by an ice layer covering the earthing switch moving contact or the earthing switch during transition from the opened position to the closed position.

According to a preferred embodiment of the present invention, the earthing switch anti-icing shield has a cross section of arc, inverted U-shape, inverted V-shape, an upper half of a trapezoid or any combination thereof, for reliably shielding the earthing blade moving contact and facilitating fall of ice and snow and rainwater therefrom.

The isolated switch with an anti-icing arrangement of the present invention has advantages such as simple and compact structure, convenient operation, reliable actions and the like. A sealed space is formed above the moving contact by mounting a shield on the moving contact blade to keep water and snow from covering the surface, which causes the moving contact being not covered by an ice layer and closing operations requiring less labor. Since the present invention further implements driving of the anti-icing arrangement by smartly using the transmission arrangement of the disconnector per se, the disconnector with an anti-icing device of the present invention has a rather compact structure. Besides, the anti-icing arrangement of the present invention can flexibly employ various shapes and dimensions without changing the working principle, thereby adapting to different disconnector with a strong universality. In addition, the anti-icing arrangement of the present disclosure can be conveniently mounted on the existing disconnector as a component and achieve a technical effect of anti-icing without replacing the existing disconnector with a new disconnector with an anti-icing arrangement, thereby substantially saving the cost of reforming the existing device.

To sum up, the technical solution of the present invention significantly improves stability and reliability of the disconnector in high and cold regions. The present invention not only can be suitable for products with 10 mmm icing, but also further fills a gap in products for over 20 mm icing. Meanwhile, the present invention is strongly universal, can be applied into various disconnectors, and also can conveniently reform the existing disconnectors using the solution of the present disclosure.

The present invention will be further described hereinafter with reference to drawings and embodiments.

BRIEF DESCRIPTION OF THE DRAWINGS

The following drawings are given to better illustrate embodiments of the present invention. It is to be understood that the drawings only illustrate preferred embodiments of the present invention in an exemplary manner and the drawings should not be interpreted as limitations to the present invention, wherein.

Throughout the description and drawings, same reference signs indicate the same or similar features or elements.

DETAILED DESCRIPTION OF EMBODIMENTS

Hereinafter, example solutions of the present invention will be explained in details with reference to the following description and the drawings. The drawings of the present application are not made exactly according to actual dimensions of the solutions according to embodiments, and changes regarding dimensions should not be interpreted as limitations to the present invention. "As illustrated in Fig . . . " or the like used hereinbelow refers to description of a particular technical feature with reference to a certain drawing. However, it should not be understood that this particular technical feature or its equivalent is included in this drawing only.

In the following description, some direction terms such as "left," "right," "up," "down," "front" and "back" and the like only denote a direction indicated with reference to the drawings. However, when the application scenario varies, the directions represented by the direction terms will change accordingly. Terms, such as "first," "second" and the like describe a plurality of components but do not mean any sequence among the components and these terms only aim to distinguish one component from another.

Figure 1:
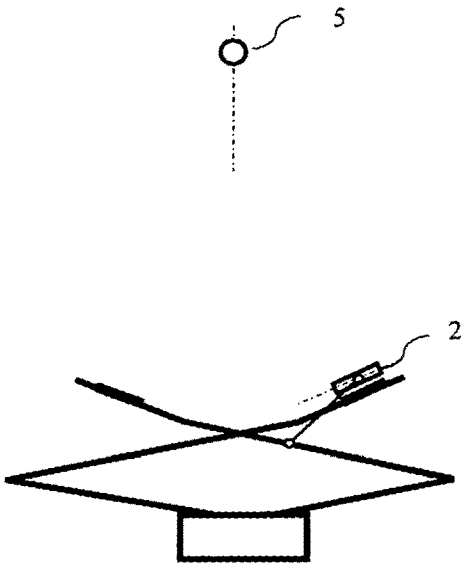
FIG. 1 is an overall schematic diagram of a disconnector at an opened position according to a preferred embodiment of the present invention.
Figure 2:
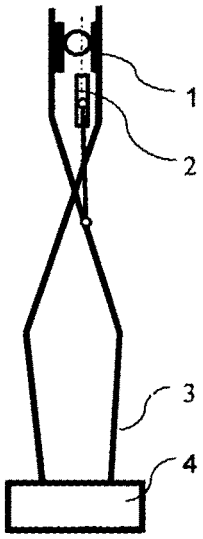
FIG. 2 is an overall schematic diagram of a disconnector at a closed position according to a preferred embodiment of the present invention.
Figure 3:
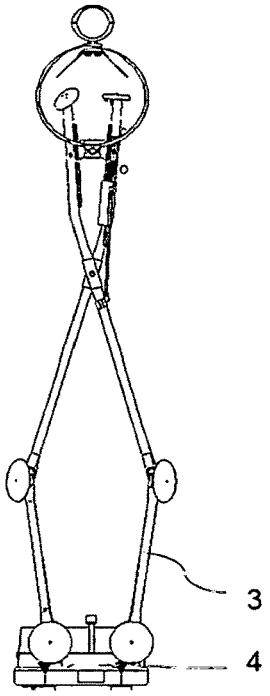
FIG. 3 is a front view of a disconnector at a closed position according to a preferred embodiment of the present invention.

FIGS. 1-3 illustrate a disconnector with an anti-icing arrangement according to an embodiment of the present invention. A sealed space is formed above a moving contact to keep water and snow from covering the surface of the moving contact, such that the moving contact is not covered with an ice layer and a closing operation becomes more reliable.

The disconnector includes a main blade moving contact 1, a main blade arm 3, a main blade static contact 5 and a main blade transmission arrangement 4 that drives the main blade arm 3 to move. A main blade anti-icing device includes a main blade anti-icing shield 2 and a main blade anti-icing shield transmission arrangement that drives the main blade anti-icing shield 2. In an opened position, the main blade anti-icing shield 2 can shield the main blade moving contact 1 as illustrated in FIG. 1, so as to keep ice and snow and rainwater from covering the surface of the main blade moving contact 1. In a closed position, the main blade anti-icing shield 2 can move away from the main blade moving contact 1 as illustrated in FIGS. 2-3, such that the main blade moving contact 1 can reliably contact the main blade static contact 5.

The anti-icing arrangement will be described in details with reference to FIGS. 4-5. It should be understood that all of descriptions are only given as examples and those skilled in the art, after review of contents of the present invention, can make various changes or modifications to the contents introduced herein. For the sake of simplicity, the text will not enumerate all possible changes, modifications or equivalents, but these changes, modifications or equivalents should certainly be included within disclosure and protection scope of the present invention.

Figure 4:
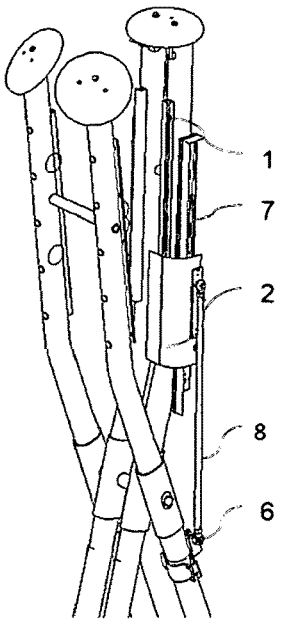
FIG. 4 is a stereogram of a disconnector at a closed position according to a preferred embodiment of the present invention.

FIG. 4 is a stereogram of the disconnector at a closed position according to an embodiment of the present invention. The main blade anti-icing shield transmission arrangement can be any suitable transmission mechanisms, and preferably a structure similar to a slider crank, i.e., including a joint 6 and a transmission shaft 8. The transmission shaft 8 has one end connected via the joint 6 to the main blade arm 3 to move along with the main blade arm 3 and another end connected to the main blade anti-icing shield 2 to drive the main blade anti-icing shield 2 to move. To further regulate movement track of the main blade anti-icing shield 2, the main blade anti-icing shield transmission arrangement can further include a main blade slide rail 7 secured on the main blade arm 3, such that the main blade anti-icing shield 2 moves along the main blade slide rail 7.

Figure 5A:
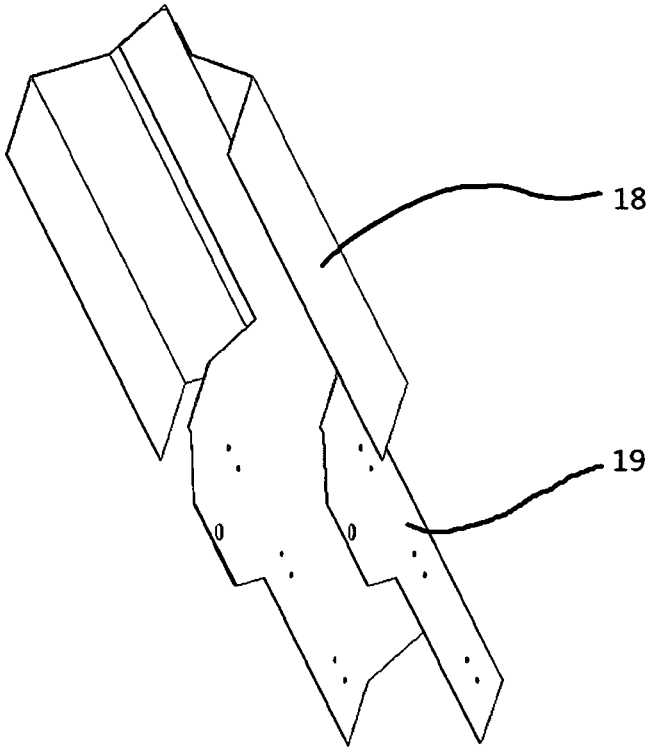
FIG. 5A is a stereogram of an anti-icing shield of a disconnector or an earthing switch according to a preferred embodiment of the present invention.
Figure 5B:
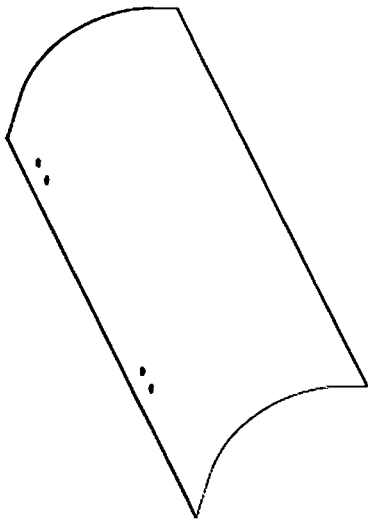
FIG. 5B is a stereogram of an anti-icing shield of a disconnector or an earthing switch according to a further preferred embodiment of the present invention.

In order to avoid block from other positions (for example, block from the ice layer covering the main blade arm 3) while the main blade anti-icing shield 2 is moving away from the main blade moving contact 1, which affects the main blade anti-icing shield 2 to smoothly concede the contact position of the moving and static contacts, and in order to better implement reliable operation of the disconnector, an icing conceding structure can also be provided on the main blade anti-icing shield 2 as illustrated in FIG. 5A to achieve reliable movement of the main blade anti-icing shield 2. The main blade anti-icing shield 2 can include a first part 18 and a second part 19, wherein the first part 18 has an opening greater than that of the second part 19, so as to prevent movement of the main blade anti-icing shield 2 from being blocked by the ice layer covering the main blade moving contact 1 or the main blade arm 3 during transition from the opened status to the closed status. The main blade anti-icing shield 2 also can be configured in a shape of an arc as illustrated in FIG. 5B. Thus, the interior space of the main blade anti-icing shield 2 has an admissible opening greater than an iced contour of un shielded part of the main blade arm 3 or the main blade moving contact 1, which, likewise, can prevent movement of the main blade anti-icing shield 2 from being blocked by the ice layer covering the main blade moving contact 1 or the main blade arm 3 during transition from the opened position to the closed position.

The main blade anti-icing shield 2 of the present invention can have various appropriate shapes as long as it can reliably shield the main blade moving contact 1. Preferably, the main blade anti-icing shield 2 has a cross section of arc, inverted U-shape, inverted V-shape, an upper half of the trapezoid or any combination thereof, which may facilitate the fall of ice and snow and rainwater therefrom.

To better understand the present invention, an operation procedure of the disconnector with an anti-icing arrangement of the present invention will be briefly described below with reference to FIGS. 1-5.

When a closing operation is performed at the opening position, the main blade transmission arrangement 4, which is actuated by the mechanism, drives the main blade arm 3 to move upward as a whole, and the main blade moving contact 1 on the main blade arm will continue the closing operation to contact the main blade static contact 5 and complete the closing operation. In the opened position, the main blade anti-icing shield 2 shields outdoor rainwater and snow, and this keeps rain and water from directly covering the main blade moving contact 1. When the closing operation is being performed, the slider crank structure at the anti-icing shield 2 is also driven due to driving of the main blade arm 3, such that the anti-icing shield 2 slowly moves away from the moving contact blade and the moving contact blade reliably contacts the main blade static contact 5 during the closing procedure, thereby completing the closing operation of the disconnector.

Cooperation of the main blade anti-icing shield transmission arrangement and the main blade anti-icing shield also can be implemented by other transmission mechanisms, for example, by directly driving the main blade anti-icing shield to move through an additional transmission arrangement. It is, not limited to jointly driving them by the main blade transmission arrangement and it works as long as the anti-icing arrangement reliably shields the moving contact and concedes the contact position of the moving and static contacts during contacting. However, those skilled in the art can understand that structure of the present invention becomes more compact and the cost gets much lower when the transmission arrangement of the disconnector per se is utilized to realize driving of the anti-icing arrangement. The transmission shaft is not limited to being secured on the main blade arm even if the transmission arrangement of the disconnector per se is utilized, and it also can be directly connected to and driven by the main blade transmission arrangement.

The disconnector with an anti-icing arrangement of the present invention has advantages, such as simple and compact structure, convenient operation, reliable actions and the like. A sealed space is formed above the moving contact by mounting a shield on the moving contact blade to keep water and snow from covering the surface, such that the moving contact is not covered with an ice layer and the closing operation costs less labor. The present invention significantly improves stability and reliability of the disconnector in high and cold regions. It is not only can be suitable for a product with 10 mmm icing, but also further fills the gap in products for over 20 mm icing. Meanwhile, the present invention is strongly universal, can be applied into various disconnectors, and also can conveniently reform the existing disconnectors using the anti-icing arrangement assembly.

Figure 6:
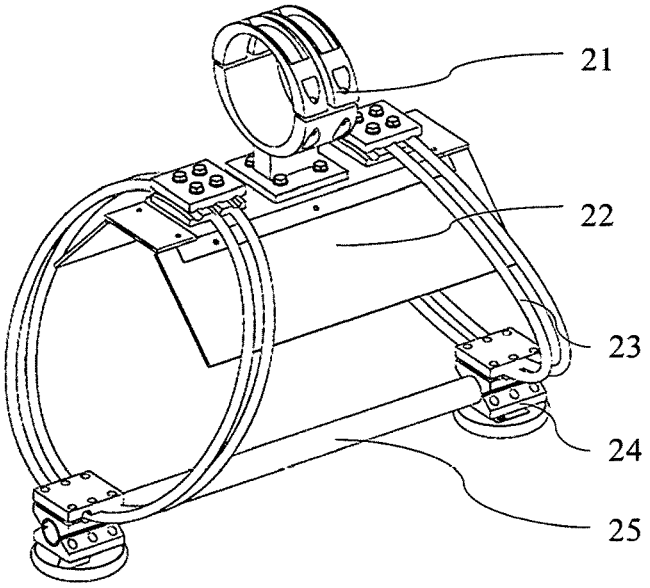
FIG. 6 is a stereogram of a main blade static contact of a disconnector according to a preferred embodiment of the present invention.

Furthermore, the static contact 5 also can further include an anti-icing arrangement to better ensure reliable contact between the moving and static contacts. As illustrated in FIG. 6, the main blade anti-icing arrangement also includes a static contact anti-icing shield 22, which can shield the main blade static contact 5 and keep ice and snow and rainwater from covering the surface of the main blade static contact 5.

In order to better understand the present invention, a common main blade static contact 5 is taken as an example. The main blade static contact 5 includes a fitting 21, an aluminum stranded wire 23, a clamp fitting 24 and a static contact copper bar 25. As illustrated in FIG. 6. The static contact anti-icing shield 22 can be secured on any positions above the static contact copper bar 25, e.g., secured on the fitting 21 and the aluminum stranded wire 23, to shield the static contact copper bar 25, and effectively protect the static contact copper bar 25 such that the ice and snow is not accumulated thereon and causes constant growth of ice layers.

The static contact anti-icing shield 22 of the present invention can have various appropriate shapes as long as it can reliably shield the main blade static contact 5. Preferably, it can have a cross section of arc, inverted U-shape, inverted V-shape, an upper half of the trapezoid, or any combination thereof, which facilitates the fall of ice and snow and rainwater therefrom.

The disconnector also can be additionally mounted with an earthing switch. When it is required to operate the disconnector, the disconnector opens; when the disconnector is opened in place, an interlocking arrangement between the disconnector and the earthing switch is opened and the earthing switch can be operated at this time. An operating structure that operates the earthing switch causes the moving contact and the static contact of the earthing switch to engage, and the earthing switch additionally mounted on the disconnector is grounded at this moment, which could realize a ground protection for other devices connected to the disconnector. Meanwhile, the interlocking arrangement also ensures that the disconnector itself cannot be closed. However, this additionally mounted earthing switch also faces the icing issue.

Figure 7:
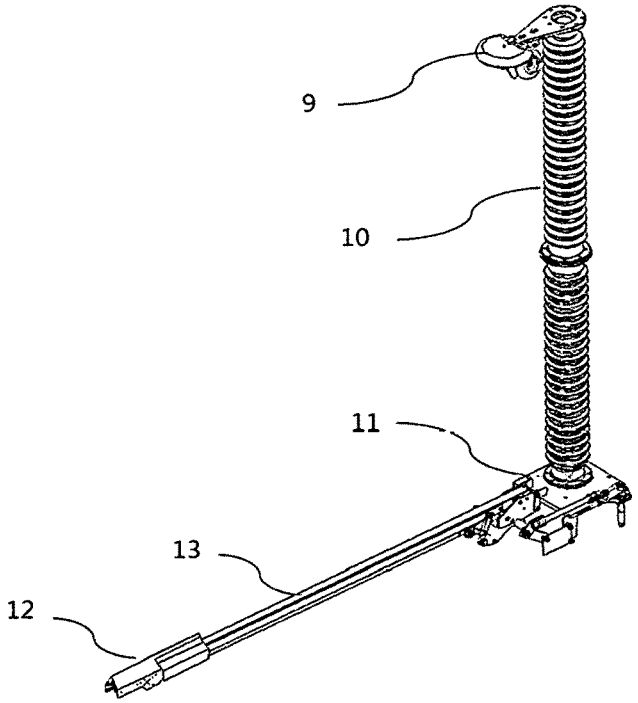
FIG. 7 is an overall structure diagram of an earthing switch of a disconnector according to a preferred embodiment of the present invention.

FIG. 7 illustrates a structure of an earthing switch additionally mounted on the disconnector, including an earthing blade static contact 9, an insulator 10, an earthing blade 13, an earthing blade moving contact 12 and a base 11. To reliably implement grounding, the earthing switch also can further include an earthing blade anti-icing shield 14 and an earthing blade anti-icing shield transmission arrangement for driving the earthing blade anti-icing shield 14. In the opened status, the earthing blade anti-icing shield 14 shields the earthing blade moving contact 12, to keep ice and snow and rainwater from covering the surface of the earthing blade moving contact 12. In the closed position, the earthing blade anti-icing shield 14 moves away from the earthing blade moving contact 12, such that the earthing blade moving contact 12 can contact the earthing blade static contact 9.

Figure 8:
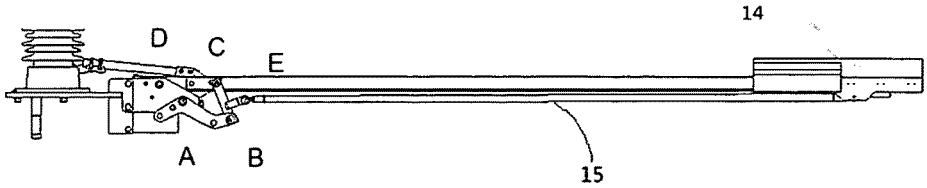
FIG. 8 is a front view of an earthing switch of a disconnector according to a preferred embodiment of the present invention.

FIG. 8 is a front view of the earthing switch of the disconnector at the opening position according to embodiments of the present invention. The earthing blade anti-icing shield transmission arrangement can be implemented by any suitable transmission mechanisms, and preferably a structure similar to a slider crank including a crank 17 and a connecting rod 15. One end 13 of the earthing blade is connected on the base 11; the crank 17 is connected between the base 11 and the earthing blade 13; and the connecting rod 15 has one end secured to the earthing blade 13 and another end connected to the earthing blade anti-icing shield 14. To further regulate movement track of the earthing blade anti-icing shield 14, the earthing blade anti-icing shield transmission device further can include an earthing blade slide rail 16 secured on the earthing blade 13, such that the earthing blade anti-icing shield 14 moves along the earthing blade slide rail 16.

In order to avoid block from other positions (e.g., block from the ice layer covering the earthing blade 13) while the earthing blade anti-icing shield 14 is moving away from the earthing blade moving contact 12, which affects the earthing blade anti-icing shield 14 to smoothly concede the contact position of the moving and static contacts, and in order to better implement reliable operation of the earthing switch, the earthing blade anti-icing shield 14 also can have a structure of the earthing blade anti-icing shield as illustrated in FIG. 5A, i.e., an icing conceding structure being provided on the earthing blade anti-icing shield 14 to achieve reliable movement of the earthing blade anti-icing shield 14. The earthing blade anti-icing shield 14 can include a front segment and a rear segment, and the front segment has an opening greater than that of the rear segment, so as to prevent movement of the earthing blade anti-icing shield 14 from being blocked by the ice layer covering the earthing blade moving contact 12 or the earthing blade 13 during transition from the opened position to the closed position. The earthing blade anti-icing shield 14 also can be configured in a shape of an arc as illustrated in FIG. 5B. Thus, the interior space of the earthing blade anti-icing shield 14 have an admissible opening greater than an iced contour of the unshielded part of the earthing blade 13 or the earthing blade moving contact 12, which, likewise, can prevent movement of the earthing blade anti-icing shield 14 from being blocked by the ice layer covering the earthing blade moving contact 12 or the earthing blade 13 during transition from the opened position to the closed position.

The earthing blade anti-icing shield 14 of the present invention can have any appropriate shape as long as it can reliably shield the earthing blade moving contact 12. Preferably, the earthing blade anti-icing shield 14 has a cross section of arc, inverted U-shape, inverted V-shape, an upper half of the trapezoid or any combination thereof, which facilitates fall of ice and snow and rainwater.

To better understand the present invention, operating procedures of the earthing switch of the disconnector having an anti-icing arrangement of the present invention will be briefly described below with reference to FIGS. 8-11. In fact, the earthing switch is a slider crank structure and for facilitating explanation, the crank 17 is indicated by AB, the connecting rod 15 is indicated by EF, one end of the earthing blade is indicated by CD, the moving contact is indicated by FG and the anti-icing shield is indicated by FH.

Figure 9:
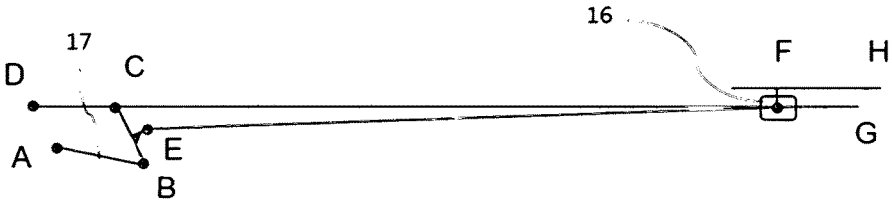
FIG. 9 is a schematic diagram of an earthing switch of a disconnector at an opening position according to a preferred embodiment of the present invention.

As illustrated in FIG. 9, the shield indicated by FH can shield the moving contact indicated by FG from ice or rainwater in the opened operation, so as to protect the moving contact. The anti-icing shield FH is covered with ice of a certain thickness after icing, and at this time, the earthing blade is driven by the operating mechanism to close.

Figure 10:
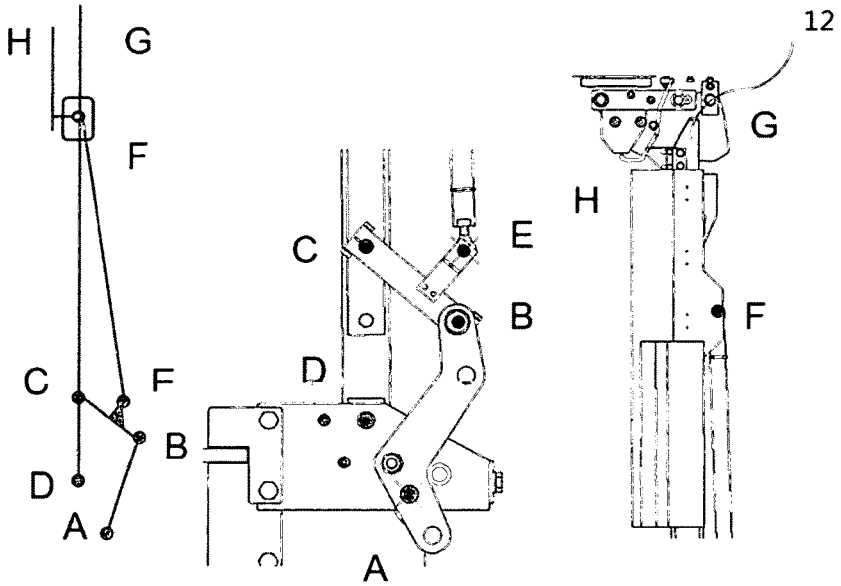
FIG. 10 is a schematic diagram of an earthing switch of a disconnector at a middle position according to a preferred embodiment of the present invention.

As illustrated in FIG. 10, the earthing blade, at a middle position, is driven by the operating mechanism to move towards the closing position. Due to operations of the slider crank structure, the F point generates relative movement on CG and CF is shortened, which drags the shield indicated by FH to move and exposes the position of the moving contact indicated by FG to the outside.

Figure 11:
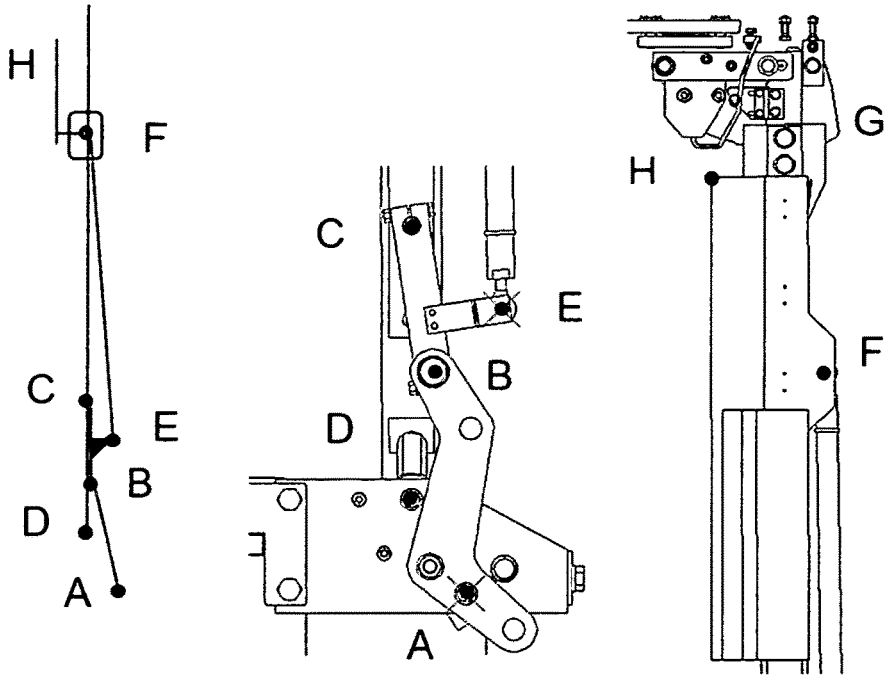
FIG. 11 is a schematic diagram of an earthing switch of a disconnector at a closed position according to a preferred embodiment of the present invention.

As illustrated in FIG. 11, when the closing operations continue to reach the closing position, the anti-icing shield indicated by FH exposes the moving contact indicated by FG, such that the moving contact indicated by FG can contact the earthing blade static contact.

Thus, the overall movement can be similar to a movement that the crank AB rotates as a drive crank such that the slider F slidably moves along the DG rod.

Cooperation of the earthing blade anti-icing shield transmission arrangement and the earthing blade anti-icing shield also can be implemented by any other transmission mechanism, for example, by directly driving the earthing blade anti-icing shield to move through an additional transmission arrangement. It is not limited to be jointly driving them by the earthing blade, and it works as long as the anti-icing arrangement reliably shields the moving contact and concedes a contact point of the moving and static contacts during contacting. However, those skilled in the art can understand that structure of the present invention becomes more compact and the cost gets lower when the transmission arrangement of the earthing switch per se is utilized to realize driving of the anti-icing arrangement. The transmission shaft is not limited to the slider crank structure even if the transmission arrangement of the earthing switch per se is utilized, and it also can adopt, for example, any other connection that can convert rotation and movement with each other.

The above technical solutions can be combined according to requirements to achieve the optimal technical effects.

The above description is just made for principles and preferred embodiments of the present invention. It should be noted that although preferred embodiments and drawings of the present invention have been disclosed for the purpose of explaining the present invention, those skilled in the art can make various substitutions, alterations and modifications without deviating from the spirit and the scope of the present invention and the attached claims. Several other variations based on the principle of the present invention also should be considered as being fallen within the protection scope of the present invention. Therefore, the present invention should not be limited to contents disclosed by preferred embodiments and drawings, and the protection scope of the present invention is defined by the attached claims.

We claim:

1. A disconnector with an anti-icing arrangement, comprising:

a main blade moving contact, a main blade arm, a main blade static contact and a main blade transmission arrangement that drives the main blade arm to move, a main blade anti-icing arrangement that includes a main blade anti-icing shield and a main blade anti-icing shield transmission arrangement, wherein the main blade anti-icing shield transmission arrangement is adapted for driving the main blade anti-icing shield, such that the main blade anti-icing shield shields the main blade moving contact in an opening operation to keep ice and snow and rainwater from covering a surface of the main blade moving contact, and moves away from the main blade moving contact in a closing operation to enable the main blade moving contact to be contacted with the main blade static contact;

wherein the main blade anti-icing shield transmission arrangement comprises a main blade slide rail secured on the main blade moving contact for enabling the main blade anti-icing shield to move along the main blade slide rail.

2. The disconnector of claim 1, wherein the main blade anti-icing transmission arrangement comprises a joint and a transmission shaft, one end of the transmission shaft being connected via the joint to the main blade arm for moving along with the main blade arm, and another end of the transmission shaft being connected to the main blade anti-icing shield.

3. The disconnector of claim 2, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

4. The disconnector of claim 1, wherein the main blade anti-icing shield comprises a first part and a second part and the first part has an opening greater than that of the second part to prevent movement of the main blade anti-icing shield from being blocked by an ice layer covering the main blade moving contact or the main blade arm during transition from the opened position to the closed position.

5. The disconnector of claim 4, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

6. The disconnector of claim 1, wherein the main blade anti-icing shield has a cross section of arc, inverted U-shape, inverted V-shape, an upper half of a trapezoid or any combination thereof, for reliably shielding the main blade moving contact and facilitating fall of ice and snow and rainwater therefrom.

7. The disconnector of claim 6, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

8. The disconnector of claim 1, wherein the main blade anti-icing arrangement further comprises a static contact anti-icing shield for shielding the main blade static contact and keeping ice and snow and rainwater from covering a surface of the main blade static contact.

9. The disconnector of claim 8, wherein the main blade static contact comprises a fitting, an aluminum stranded wire, a clamp fitting and a static contact copper bar, the static contact anti-icing shield adapted for shielding the static contact copper bar.

10. The disconnector of claim 9, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

11. The disconnector of claim 8, wherein the static contact anti-icing shield has a cross section of arc, inverted U-shape, inverted V-shape, an upper half of a trapezoid or any combination thereof, for reliably shielding the main blade static contact and facilitating fall of ice and snow and rainwater therefrom.

12. The disconnector of claim 11, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

13. The disconnector of claim 8, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

14. The disconnector of claim 1, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

15. The disconnector of claim 14, wherein the earthing blade anti-icing shield transmission arrangement comprises a crank and a connecting rod, one end of the earthing blade being connected to the base, the crank being connected between the base and the earthing blade, one end of the connecting rod being secured on the earthing blade and another end being connected to the earthing blade anti-icing shield.

16. The disconnector of claim 14, wherein the earthing blade anti-icing shield comprises a front segment and a rear segment, the front segment has an opening greater than that of the rear segment to avoid movement of the earthing blade anti-icing shield from being blocked by an ice layer covering the earthing blade moving contact or the earthing blade during transition from the opened position to the closed position.

17. The disconnector of claim 14, wherein the earthing blade anti-icing shield has a cross section of arc, inverted U-shape, inverted V-shape, an upper half of a trapezoid or any combination thereof, for reliably shielding the earthing blade moving contact and facilitating fall of ice and snow and rainwater therefrom.

18. The disconnector of claim 1, wherein the disconnector further comprises an additionally mounted earthing switch including an earthing blade static contact, an insulator, an earthing blade, an earthing blade moving contact and a base, and the earthing switch further comprises an earthing blade anti-icing arrangement comprises an earthing blade anti-icing shield and an earthing blade anti-icing shield transmission arrangement, wherein the earthing blade anti-icing shield transmission arrangement is adapted for driving the earthing blade anti-icing shield such that the earthing blade anti-icing shield shields the earthing blade moving contact in the opened position to keep ice and snow and rainwater from covering a surface of the earthing blade moving contact, and moves away from the earthing moving contact in the closed position to enable the earthing blade moving contact to be contacted with the earthing blade static contact.

* * * * *